US007628873B2

(12) United States Patent
Ota et al.

(10) Patent No.: US 7,628,873 B2
(45) Date of Patent: Dec. 8, 2009

(54) BERYLLIUM COPPER ALLOY AND METHOD OF MANUFACTURING BERYLLIUM COPPER ALLOY

(75) Inventors: Satoshi Ota, Handa (JP); Naokuni Muramatsu, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 314 days.

(21) Appl. No.: 11/518,507

(22) Filed: Sep. 8, 2006

(65) Prior Publication Data

US 2007/0056661 A1 Mar. 15, 2007

(30) Foreign Application Priority Data

Sep. 9, 2005 (JP) ..... 2005-262996

(51) Int. Cl.
*C22C 9/00* (2006.01)

(52) U.S. Cl. ..... 148/435; 420/485; 420/486; 420/487; 420/488

(58) Field of Classification Search ..... 148/435; 420/485–488
See application file for complete search history.

(56) References Cited

U.S. PATENT DOCUMENTS 4,533,412 A 8/1985 Rotem
4,696,704 A 9/1987 Takeuchi et al.
5,074,922 A 12/1991 Hiramitsu et al.
5,993,574 A 11/1999 Harkness et al.
6,001,196 A 12/1999 Harkness et al.
6,083,328 A 7/2000 Gravemann et al.
6,153,031 A 11/2000 Harkness et al.
6,190,468 B1 * 2/2001 Longenberger ..... 148/435

FOREIGN PATENT DOCUMENTS

DE 0 548 636 A1 12/1991
JP 01-165736 A1 6/1989
JP 05-247565 A1 9/1993
JP 10-183276 A1 7/1998

OTHER PUBLICATIONS

"Journal of the Japan Copper and Brass Research Association", Japan Copper and Brass Association, 1976, vol. 15, pp. 154.

* cited by examiner

*Primary Examiner*—Sikyin Ip
(74) *Attorney, Agent, or Firm*—Burr & Brown

(57) ABSTRACT

A beryllium copper alloy is provided, having a thickness "t" in a range from 0.05 mm to 0.5 mm and having an alloy composition consisting by weight (or mass %), of $Cu_{100-(a+b)}Ni_aBe_b$, wherein $1.0 \leqq a \leqq 2.0$, $0.15 \leqq b \leqq 0.35$, and $5.5 \leqq a/b \leqq 6.5$. The beryllium copper alloy also exhibits a 0.2% proof stress equal to or above 650 MPa, an electric conductivity equal to or above 70% IACS, and a bending formability defined by a ratio of R/t=0, wherein "R" is a maximum bend radius before cracking at a bent portion when the beryllium copper alloy is bent into a V shape at a right angle.

3 Claims, 3 Drawing Sheets

BERYLLIUM COPPER ALLOY AND METHOD OF MANUFACTURING BERYLLIUM COPPER ALLOY

CROSS REFERENCE TO RELATED APPLICATIONS

This application is based upon and claims the benefit of priority from prior Japanese Patent Application No. 2005-262996, filed on 9, Sep., 2006, the entire contents of which are incorporated herein by reference.

BACKGROUND OF THE INVENTION

1. Field of the Invention

The present invention relates to a beryllium copper alloy containing beryllium (Be), nickel (Ni), and copper (Cu), and a method of manufacturing this beryllium copper alloy.

2. Description of the Related Art

Conventional copper alloys containing beryllium, nickel, and copper (hereinafter referred to as a "beryllium copper alloys") are widely used for spring materials, relays, terminals, connecters, lead frames, and the like (hereinafter collectively referred to as "lead frames, etc."). The strength (such as 0.2% proof stress) and the electric conductivity (such as the International Annealed Copper Standard or IACS) of such beryllium copper alloys are required to be desired values or higher.

Beryllium copper alloys in each of which the alloy composition (or mass %) of beryllium and nickel are controlled in pursuit of improvement in strength and in electric conductivity is disclosed (see *Journal of the Japan Copper and Brass Research Association*, Japan Copper and Brass Association, Vol. 15, pp. 154 left column 6L-17L, for example). Specifically, a beryllium copper alloy with an alloy composition by weight (or mass %) of $CuNi_2Be_{0.18}$ or of $CuNi_1Be_{0.25}$ has an excellent strength by being hardened in age hardening process and an electric conductivity of from 50% to 60% IACS (hereinafter referred to as a first beryllium copper alloy).

A beryllium copper alloy with improved strength and electric conductivity by adding tin (Sn), zirconium (Zr), and titanium (Ti) is also disclosed (see Japanese Unexamined Patent Publication No. 10(1998)-183276, especially claim 1 and Table 5-8). Specifically, a beryllium copper alloy with an alloy composition by weight (or mass %) of $CuNi_{0.4\text{-}1.25}Be_{0.15\text{-}0.5}Zr(\text{and/or Ti})_{0.06\text{-}1.0}Sn_{0\text{-}0.25}$ has a strength of 556-MPa and an electric conductivity of 66% IACS (hereinafter referred to as a second beryllium copper alloy).

Furthermore, a beryllium copper alloy applicable to a relatively large-size member such as a rolling-mill roll is also disclosed (see Japanese Patent Publication No. 3504284, especially claim 1, claim 3, and Table 4, etc.). The method of manufacturing the alloy includes the controlling of the Be/Ni content ratio (hereinafter referred to as "Be/Ni ratio"). Specifically, a beryllium copper alloy with an alloy composition by weight (mass %) of $CuNi_{1.2\text{-}2.6}Be_{0.1\text{-}0.45}$ and a Be/Ni ratio of from 5.5 to 7.5 a beryllium copper alloy has a combination of a strength and an electric conductivity of 681 Mpa—68.4% LACS (40.2 m/Ωmm$^2$) or 711 Mpa—68.2% IACS (40.1 m/Ωmm$^2$) (hereinafter referred to as a third beryllium copper alloy).

SUMMARY OF THE INVENTION

A first aspect of the present invention provides a method of manufacturing a beryllium copper alloy having a thickness in a range from 0.05 mm to 0.5 mm. The method includes a solution heat treatment, a cold rolling, and an age hardening. In the solution heat treatment step, a copper alloy having an alloy composition by weight (or mass %) of $Cu_{100-(a+b)}Ni_aBe_b$ ($1.0 \leqq a \leqq 2.0$, $0.15 \leqq b \leqq 0.35$, $5.5 \leqq a/b \leqq 6.5$) is heated to a solid solution temperature region. In the solid solution temperature region, Ni and Be are solid-solved in Cu. The copper alloy heated to the solid solution temperature region is quenched at a predetermined cooling rate. In the cold rolling step, plastic strain is applied to the copper alloy quenched in the solid solution heat treatment step in a temperature region where Ni and Be do not precipitate. In the age hardening step, the copper alloy to which the plastic strain is applied in the cold rolling step, is retained in the age hardening temperature region where Ni and Be precipitate for a predetermined age hardening period. Additionally, the steps of the cold rolling and of the age hardening are repeated at least once.

According to this aspect, since precipitation of precipitate composed of Ni and Be is promoted, it is possible to improve the electric conductivity (IACS) of the beryllium copper alloy, by setting the alloy composition by weight (or mass %) at $Cu_{100-(a+b)}Ni_aBe_b$ ($1.0 \leqq a \leqq 2.0$, $0.15 \leqq b \leqq 0.35$, $5.5 \leqq a/b \leqq 6.5$). Moreover, it is possible to improve the electric conductivity (IACS) of the beryllium copper alloy as a whole by reducing the content (mass %) of Ni and that of Be.

The beryllium copper alloy has a degraded strength (0.2% proof stress) because of the reduction of the content (mass %) of Ni and that of Be. However, the cold rolling step and the age hardening step repeated at least once, it is possible to improve the strength (0.2% proof stress) of the beryllium copper alloy.

In other words, according to the above-described manufacturing method, it is possible to manufacture a beryllium copper alloy, even in a thin plate or a strip, which has enough strength and enough electric conductivity simultaneously to be used for lead frames, etc.

In a second aspect of the present invention in addition to the first aspect, the solid solution temperature region is set in a range from 850° C. to 1000° C., and the predetermined cooling rate is set at $-100°\ Cs^{-1}$ or higher.

In a third aspect of the present invention in addition to the first aspect, the amount of the plastic strain applied to the copper alloy in one round of the cold rolling step is 0.05 or greater, and the cumulative amount of the plastic strain applied to the copper alloy in the cold rolling step is 0.3 or greater.

In a fourth aspect of the present invention in addition to the attributes of the first aspect, the amount of the plastic strain applied to the copper alloy in the first cold rolling step executed after the quenching of the copper alloy in the solution heat treatment step is equal to or greater than the amount applied in the second or later cold rolling step.

In a fifth aspect of the present invention in addition to the first aspect, the age hardening temperature region is set in a range from 400° C. to 530° C., and the predetermined age hardening period is set in a range from 3 minutes to 24 hours.

A sixth aspect of the present invention provides a beryllium copper alloy which has a thickness in a range from 0.05 mm to 0.5 mm, an alloy composition by weight (or mass %) of $Cu_{100-(a+b)}Ni_aBe_b$ ($1.0 \leqq a \leqq 2.0$, $0.15 \leqq b \leqq 0.35$, $5.5 \leqq a/b \leqq 6.5$), a 0.2% proof stress of 650 MPa or larger, and an electric conductivity of 70% IACS or higher.

In a seventh aspect of the present invention in addition to the sixth aspect, crystal grains formed in the beryllium copper alloy have an average crystal grain size in a range from 5 μm to 35 μm.

In an eighth aspect of the present invention in addition to the sixth aspect, the beryllium copper alloy has a difference of 40 MPa or larger between its ultimate tensile strength (UTS) and its 0.2% proof stress.

DETAILED DESCRIPTION OF THE INVENTION

Embodiment (Beryllium Copper Alloy)

Figure 1:
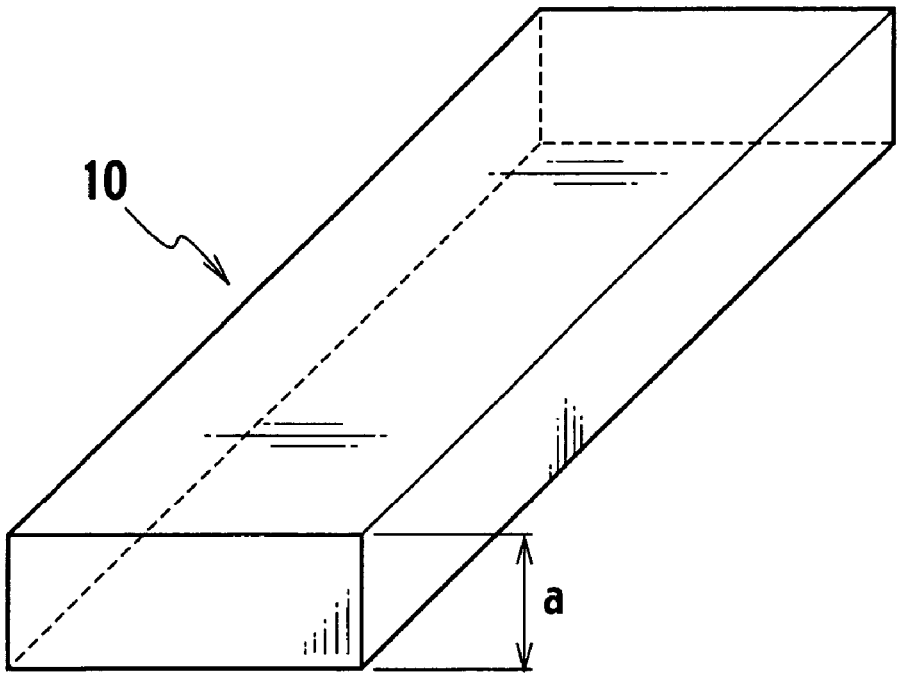
FIG. 1 is a schematic perspective view showing a beryllium copper alloy 10 of an embodiment of the present invention.

Now, a beryllium copper alloy of an embodiment of the present invention will be described below with reference to the accompanying drawings. FIG. 1 is a schematic perspective view showing a beryllium copper alloy 10 according to an embodiment of the present invention.

As shown in FIG. 1, the beryllium copper alloy 10 has a thin plate shape or a strip shape, and a thickness a in a range from about 0.05 mm to 0.5 mm. Here, the thickness a of the beryllium copper alloy in the range from about 0.05 mm to 0.5 mm is the optimum thickness for spring materials, relays, terminals, connecters, lead frames, and the like (hereinafter collectively referred to as "lead frames, etc.").

The alloy composition by weight (or mass %) of the beryllium copper alloy is expressed as $Cu_{100-(a+b)}Ni_aBe_b$ ($1.0 \leqq a \leqq 2.0$, $0.15 \leqq b \leqq 0.35$, $5.5 \leqq a/b \leqq 6.5$).

Reasons for setting the alloy composition by weight (or mass %) of the beryllium copper alloy to $Cu_{100-(a+b)}Ni_aBe_b$ ($1.0 \leqq a \leqq 2.0$, $0.15 \leqq b \leqq 0.35$, $5.5 \leqq a/b \leqq 6.5$) are as follows.

A content (mass %) of Ni below 1.0 and a content of Be below 0.15 make the crystal grains coarsened and make the beryllium copper alloy fragile. A content of Ni above 2.0 and a content of Be above 0.35 conversely soften the beryllium copper alloy in age hardening process, by influence of coarse precipitate composed of Ni and Be. This makes it impossible to obtain an alloy with a desired strength (0.2% proof stress).

A reason for setting the Ni/Be ratio (a/b) in the range from 5.5 to 6.5 is to obtain a 1:1 content ratio of Ni to Be in the precipitate in spite of the difference in atomic weight between Ni (58.7) and Be (9.0). This content ratio of 1:1 of Ni and Be in the precipitate improves the electric conductivity of the beryllium copper alloy.

Note that the atomic weight of Ni is 58.7 and that of Be is 9.0, and the atomic weight ratio of Ni to Be is $58.7/9.0 \approx 6.5$. The Ni/Be ratio (a/b) in this embodiment is set, somewhat less exactly, in a range from 5.5 to 6.5. This is because, when Ni and Be solid-solved in Cu precipitate, some Be may probably remain unprecipitated and stay in Cu.

Note that details of the Ni/Be ratio (a/b) are disclosed in *Journal of the Japan Institute of Metals*, Vol. 36, p. 1034, 1972, and in *Copper and Copper Alloys*, Vol. 41-1, p. 7, left column L.6 to L.15, 2002.

In addition, the beryllium copper alloy has a 0.2% proof stress of 650 MPa or larger and an electric conductivity of 70% IACS or higher. Moreover, crystal grains formed in the alloy have an average crystal grain size in a range from 5 μm to 35 μm.

Furthermore, the beryllium copper alloy has a difference of 40 MPa or larger between its ultimate tensile strength (UTS) and its 0.2% proof stress. Here, the ultimate tensile strength represents a maximum stress applied to the beryllium copper alloy 10 when the alloy 10 is subjected to bending deflection until the alloy 10 breaks.

The difference between the ultimate tensile strength of the beryllium copper alloy and the 0.2% proof stress thereof is set equal to or above 40 MPa because the alloy, applied to use as lead frames, etc., is made less breakable when bended. In other words, the difference makes the alloy more workable.

(Method of Manufacturing Beryllium Copper Alloy)

Figure 2:
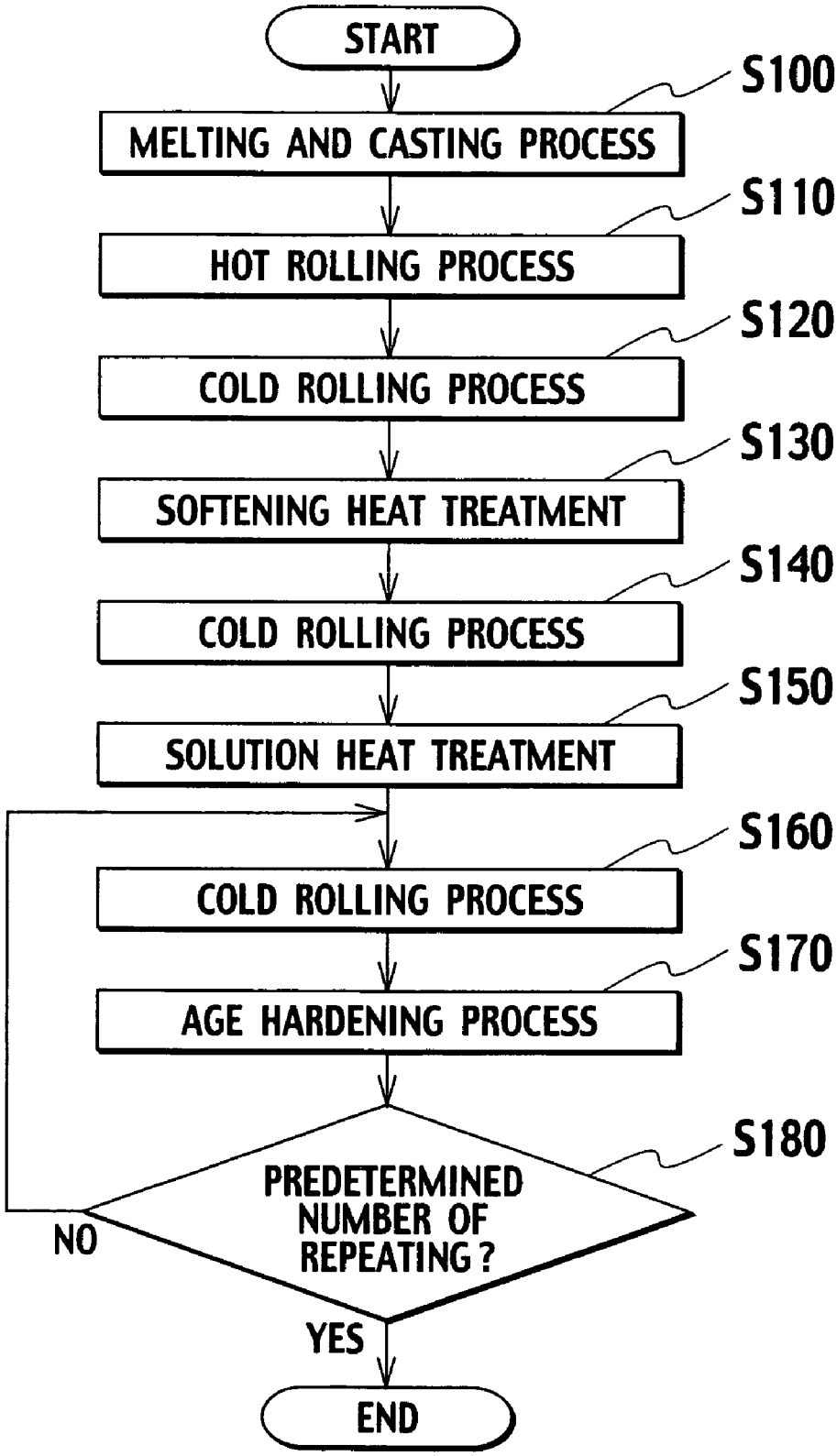
FIG. 2 is a flowchart showing a method of manufacturing the beryllium copper alloy 10 of the embodiment of the present invention.

Now, a method of manufacturing a beryllium copper alloy of the embodiment of the present invention will be described below with reference to the accompanying drawings. FIG. 2 is a flowchart showing a method of manufacturing the beryllium copper alloy 10 according to the embodiment of the present invention.

As shown in FIG. 2, in Step S100, a copper alloy having an alloy composition (or mass %) of $Cu_{100-(a+b)}Ni_aBe_b$ ($1.0 \leqq a \leqq 2.0$, $0.15 \leqq b \leqq 0.35$, $5.5 \leqq a/b \leqq 6.5$) is melted in a high-frequency melting furnace, and the melted copper alloy is cast to obtain a billet of the copper alloy.

In Step S110, the copper alloy cast into the billet in Step S100 is hot-rolled by a rolling mill.

In Step S120, the copper alloy hot-rolled in Step S110 is cold-rolled by use a rolling mill.

In this way, the copper alloy cast into the billet is rolled in Step S110 and Step S120 to obtain the copper alloy with a strip shape.

In Step S130, the copper alloy strip is heated up to or above an overaging temperature of the copper alloy.

In Step S140, the copper alloy heated up to or above the overaging temperature in Step S130 is cold-rolled by a rolling mill.

In this way, the copper alloy strip is rolled in Step S130 and Step S140 to obtain the copper alloy having a thinner strip shape. Here, when it is not necessary to form the copper alloy obtained in Step S110 and Step S120 into the thinner strip shape, the processes of Step S130 and of Step S140 may be omitted.

In Step S150, the copper alloy cold-rolled in Step S140 is heated up to the solid solution temperature region, and then the copper alloy heated to the solid solution temperature region is quenched at a predetermined cooling rate. Specifically, the copper alloy cold-rolled in Step S140 is heated up to a temperature range from about 850° C. to 1000° C. (the solid solution temperature region), and then the copper alloy heated to the solid solution temperature region is quenched at a rate approximately of $-100°\ Cs^{-1}$ or faster (the predetermined cooling rate).

Note that the crystal grains of the copper alloy quenched in Step S150 has an average crystal grain size in a range from about 5 μm to 35 μm.

In Step S160, the copper alloy is subjected to plastic strain in a (cold) temperature region where Ni and Be solid-solved in Cu do not precipitate. Specifically, a plastic strain of a range from about 0.05 to 0.4 is applied to the copper alloy. In other words, the copper alloy is rolled at a rolling ratio of a range from about 5% to 40%.

Note that the amount of plastic strain to be applied in one round of cold rolling process is set approximately equal to 0.05 or above. In order to obtain the desired strength (the 0.2% proof stress) and the desired electric conductivity (IACS), the process (an age hardening process) of Step S170 tends to take a longer time. The above setting of plastic strain amount prevents an extension of predetermined age hardening period (to be described later).

Moreover, when the thickness before rolling is defined as L and the thickness after rolling as l, the amount of plastic strain e is expressed by e=(L−l)/L.

In Step S170, the copper alloy rolled in step S160 is retained for a predetermined age hardening period in an age hardening temperature region where Ni and Be solid-solved in Cu precipitate. Specifically, the copper alloy rolled in step S160 is retained for from about 3 minutes to 24 hours at from about 400° C. to 530° C.

Here, in order to obtain sufficient electric conductivity (IACS) by the age hardening process, the age hardening temperature is set at about 400° C. or higher. And to obtain sufficient strength (the 0.2% proof stress) by the age hardening process, the age hardening temperature is set at about 530° C. or lower.

In Step S180, a judgment is made as to whether or not the number of repeating the processes of Step S160 and Step S170 is a predetermined number. When the number of repeating the processes of Step S160 and Step S170 is the predetermined number, the manufacturing flow related to the method of this embodiment is terminated. When the number of repeating the processes in Step S160 and Step S170 does not reach the predetermined number, the manufacturing flow returns to the process of Step S160.

Note that the predetermined number of repeating is at least one. In other words, the processes in Step S160 and Step S170 are carried out at least twice after the process of Step S150 (a solution heat treatment).

Here, the amount of plastic strain (the rolling ratio) applied to the copper alloy in the first-time process of Step S160 (a cold rolling process) carried out immediately after the process in Step S150 (the solution heat treatment) is equal to or greater than the amount applied in the second or later round of the process of Step S160.

The amount of plastic strain applied to the copper alloy in the first-time process of Step S160 is set equal to or greater than the amount applied in the second or later round of the process of Step S160 because of the following reason. The copper alloy subject to the plastic strain in the second or later round of the process of Step S160 has already been hardened through the first-time processes of Step S160 and Step S170. Accordingly, it is not preferable to apply a plastic strain in the second or later round of the process in Step S160 greater than that of the first-time process in Step S160.

The cumulative amount of the plastic strain applied to the copper alloy in the processes of Step S160 (the cold rolling process) is equal to or above 0.3. That is, the copper alloy is rolled by the plural times of the processes of Step S160 so as to satisfy the cumulative rolling ratio equal to or above 30%.

In order to obtain the desired strength (the 0.2% proof stress) and the desired electric conductivity (IACS), the cumulative amount of the plastic strain applied to the copper alloy in the processes carried out a predetermined number of times is set equal to or above 0.3. This prevents the predetermined age hardening period in the processes (the age hardening processes) in Step S170 from extending too long.

(Advantages)

According to the method of manufacturing the beryllium copper alloy 10 of the embodiment of the present invention, since precipitation of precipitate composed of Ni and Be is promoted, the beryllium copper alloy 10 with the alloy composition by weight (mass %) of $Cu_{100-(a+b)}Ni_aBe_b$ ($1.0 \leqq a \leqq 2.0$, $0.15 \leqq b \leqq 0.35$, $5.5 \leqq a/b \leqq 6.5$) has an improved electric conductivity (IACS). Moreover, the beryllium copper alloy 10, which has a lower content of Ni and a lower content of Be than C17510 ($Cu_{100-(a+b)}Ni_aBe_b$ ($1.4 \leqq a \leqq 2.2$, $0.2 \leqq b \leqq 0.6$) as defined in ASTM B442, has an improved electric conductivity of the alloy 10 as a whole.

Further, reducing the content (mass %) of Ni and Be brings about a decreased strength (the 0.2% proof stress) of the beryllium copper alloy 10. Repeating the cold rolling process and the age hardening process at least once can improve the once-lowered strength.

According to the above-described manufacturing method, it is possible to obtain the beryllium copper alloy 10, even in a thin plate shape or a strip shape, which has an enough strength and an enough electric conductivity simultaneously to be applicable to the lead frames, etc.

Specifically, in a conventional manufacturing method, the cold rolling process and the age hardening process are not repeated. Reasons for this are that the manufacturing steps should not be complicated and that a sufficient strength (the 0.2% proof stress) is obtained by performing these processes only once.

Moreover, in the conventional manufacturing method, repeating the cold rolling process is difficult because the strength (the 0.2% proof stress) of the beryllium copper alloy becomes too high once the cold rolling process and the age hardening process that succeed the solution heat treatment are carried out.

In contrast, the method of manufacturing the beryllium copper alloy 10 according to the embodiment of the present invention has a significant difference from the conventional manufacturing method. The electric conductivity (IACS) of the alloy 10 is improved as a whole by reducing the contents (mass %) of Ni and Be. The strength (the 0.2% proof stress) of the alloy 10, however, once dropped by reducing the contents (mass %) of Ni and Be is improved by repeating the cold rolling process and the age hardening process at least once.

Moreover, it is possible to form the average crystal grain size of the crystal grains of the beryllium copper alloy 10 in the range from 5 μm to 35 μm by setting the solution temperature region at from about 850° C. to 1000° C. and by setting the cooling rate to −100° $Cs^{-1}$.

Further, by setting the amount of the plastic strain applied to the copper alloy in one round of the cold rolling process (the process of Step S160) equal to or above 0.05 and by setting the cumulative amount of the plastic strain applied to the copper alloy in the cold rolling process equal to or above 0.3, it is possible to prevent extension of the predetermined age hardening period needed to obtain the desired strength (the 0.2% proof stress) and the desired electric conductivity (IACS) in the age hardening process (the process of Step S170).

Meanwhile, by rendering the amount of the plastic strain applied to the copper alloy in the first-time cold rolling process (the process of Step S160) equal to or greater than the amount of the plastic strain applied to the copper alloy in the second or later round of the cold rolling process, it is possible to apply the plastic strain to the copper alloy easily in the second or later round of rolling processes even after the copper alloy is hardened by the first-time cold rolling process.

In addition, it is possible to obtain the beryllium copper alloy 10 having a sufficient electric conductivity (IACS) and a sufficient strength (the 0.2% proof stress) applicable to the lead frames, etc., by setting the age hardening temperature at from about 400° C. to 530° C.

EXAMPLES

Now, evaluation findings of the beryllium copper alloy 10 manufactured in accordance with the above-described manufacturing method will be described. Table 1 is a table showing allowing composition by weight (mass %) of the beryllium copper alloys and also showing the Ni/Be ratios representing the proportions between the content of Ni and that of Be.

TABLE 1

| Lot. ID | Content of Ni (mass %) | Content of Be (mass %) | Ni/Be ratio |
|---|---|---|---|
| A | 1.30 | 0.22 | 5.9 |
| B | 2.10 | 0.36 | 5.8 |
| C | 0.90 | 0.16 | 5.6 |
| D | 1.00 | 0.14 | 7.1 |
| E | 1.30 | 0.26 | 5.0 |

Several types of copper alloys (Lot. A to Lot. E) having different alloy compositions by weight (or mass %) are prepared as shown in Table 1. Lot. A is a copper alloy having the composition of the embodiment of the present invention, and Lot. B to Lot. E are copper alloys having compositions related to comparative examples. Specifically, Lot. B has a content (mass %) of Ni above 2.0 and a content (mass %) of Be above 0.35, and is therefore different from the copper alloy of the present invention. Lot. C has a content (mass %) of Ni below 1.0 and is therefore different from the copper alloy of the present invention. Lot. D has a content (mass %) of Be below 0.15 and a Ni/Be ratio above 0.65, and is therefore different from the copper alloy of the present invention. Lot. E has a Ni/Be ratio below 5.5 and is therefore different from the copper alloy of the present invention.

Table 2 is a table showing results of comparison between beryllium copper alloys manufactured by the manufacturing method of the embodiment of the invention and beryllium copper alloys manufactured by a manufacturing method of the comparative examples.

Specifically, the copper alloys (Lot. A to Lot. E) having the above-described alloy composition by weight (mass %) are respectively melted in a high-frequency melting furnace to obtain cylindrical ingots having dimensions of a diameter of 80 mm and a height of 100 mm. Meanwhile, these cylindrical ingots are homogenized by retaining the cylindrical ingots at 900° C. over 6 hours. Then, sample members each having dimensions of a thickness of 10 mm, a width of 50 mm, and a length of 60 mm are cut out. Moreover, the sample members are subjected to hot rolling processes, cold rolling processes, and softening heat treatments as appropriate. In this way, each of the sample members is processes into a thickness of 0.4 mm.

Next, the sample members processed into the thickness of 0.4 mm are heated up to 900° C. to establish solid solution of Ni and Be into Cu. Thereafter, the cold rolling process and the age hardening process are repeated as appropriate under conditions shown in Table 2.

Note that Table 2 shows values of average crystal grain sizes which are calculated by the quadrature method (see JIS H0501). Meanwhile, fatigue property shows the numbers of times of bending deflection applied to the respective beryllium copper alloys until the beryllium copper alloys get broken. The bending deflection is applied by means of repetitively subjecting the beryllium copper alloys to achieve maximum stress on surfaces thereof equal to 400 MPa (see Japan Copper and Brass Association (JCBA) T308 or JIS Z2273).

Moreover, stress relaxation property is a value of a residual stress. The residual stress is the stress which remains in the beryllium copper alloys after retaining the alloys at 150° C. for 1000 hours in the state of bending deflection so as to achieve the maximum stress on the surfaces equal to 75% of the 0.2 proof stress thereof. To be more precise, each of the values represents a value calculated by dividing a difference between the initial stress applied to the alloy and the relaxation stress by the initial stress (see JCBA T309 or ASTM E328).

The bending formability is a value calculated by dividing a maximum bend radius R before causing a crack at the bent portion of the beryllium copper alloy bent into a V shape at a right angle, by the thickness of the sample member (see JIS Z2248).

TABLE 2

| | | | First round | | Second round | | | |
|---|---|---|---|---|---|---|---|---|
| | Lot. ID | Sample No. | Rolling ratio (%) | Age hardening temperature (° C.) | Rolling ratio (%) | Age hardening temperature (° C.) | Average crystal grain size (μm) | 0.2% proof stress (MPa) |
| Examples | A | 1 | 30 | 530 | 20 | 400 | 18 | 650 |
| | | 2 | 50 | 480 | 10 | 450 | 18 | 680 |
| | | 3 | 50 | 460 | 10 | 430 | 18 | 690 |
| Comparative Examples | A | 4 | 40 | 500 | 10 | — | 18 | 710 |
| | | 5 | 40 | 500 | — | — | 18 | 610 |
| | B | 6 | 40 | 500 | 10 | 430 | 7 | 500 |
| | C | 7 | 40 | 500 | 10 | 430 | 100 | 590 |
| | D | 8 | 70 | 450 | — | — | n.a. | 390 |
| | E | 9 | 70 | 450 | 10 | 450 | n.a. | 670 |

| | Lot. ID | Sample No. | Ultimate tensile strength (MPa) | Electric conductivity (% IACS) | Fatigue property ($\times 10^4$) | Stress relaxation property (%) | Bending formability |
|---|---|---|---|---|---|---|---|
| Examples | A | 1 | 700 | 70 | 350 | 82 | 0 |
| | | 2 | 720 | 71 | 350 | 82 | 0 |
| | | 3 | 730 | 70 | 350 | 83 | 0 |
| Comparative Examples | A | 4 | 740 | 68 | n.a. | 68 | 2.5 |
| | | 5 | 675 | 72 | 200 | 81 | 0 |
| | B | 6 | 630 | 70 | 450 | 70 | 0 |

TABLE 2-continued

| | | | | | | |
|---|---|---|---|---|---|---|
| C | 7 | 650 | 72 | 100 | 87 | 2 |
| D | 8 | 450 | 75 | n.a. | n.a | n.a |
| E | 9 | 715 | 65 | n.a | n.a | n.a |

As shown in Table 2, the beryllium copper alloys (Samples No. 1 to No. 3) manufactured by the above-described manufacturing method by use of the copper alloy (Lot. A) of the embodiment of the present invention achieved desired values of average crystal grain size, of 0.2% proof stress, and of electric conductivity.

To be more precise, Samples No. 1 to No. 3 showed that the beryllium copper alloys having an average crystal grain size of from 5 μm to 35 μm, a 0.2% proof stress of 650 MPa or larger, and an electric conductivity of 70% IACS or higher were obtainable. Moreover, Samples No. 1 to No. 3 showed that the beryllium copper alloys having a favorable fatigue characteristic, a favorable proof stress relaxation characteristic, and a favorable bending formability were obtainable. Further, Samples No. 1 to No. 3 showed that the beryllium copper alloys having the 0.2% proof stress of 650 MPa or larger and a difference of 40 MP or larger between the 0.2% proof stress and the ultimate tensile strength were obtainable.

In contrast, the beryllium copper alloys (Samples No. 4 to No. 9) manufactured by the manufacturing method of the comparative examples could not achieve desired a desired average crystal grain size, a desired 0.2% proof stress, or a desired electric conductivity.

Specifically, Samples No. 4 and No. 5 showed that the beryllium copper alloys having the characteristics of a 0.2% proof stress of 650 MPa or larger and a electric conductivity of 70% IACS or higher simultaneously were not obtainable even by use of the copper alloy having the alloy composition of an example of the present invention. To be more precise, Sample No. 4 showed that the stress relaxation property, the bending formability, and so forth were deteriorated when the cold rolling process alone was repeated, being not accompanied by the age hardening process.

Samples No. 6, No. 7, and No. 9 showed that the beryllium copper alloys having a 0.2% proof stress of 650 MPa or larger and an electric conductivity of 70% IACS or higher simultaneously were not obtainable even when they were manufactured by the above-described manufacturing method. This was because a copper alloy having an alloy composition different from that of the copper alloy of the present invention were used in the manufacturing.

Sample No. 8 showed that the beryllium copper alloy having a 0.2% proof stress of 650 MPa or larger and an electric conductivity 70% IACS or higher simultaneously was not obtainable when the alloy was manufactured by a manufacturing method different from the above-described manufacturing method and by use of a copper alloy having an alloy composition different from that of the copper alloy of the present invention.

Figure 3:
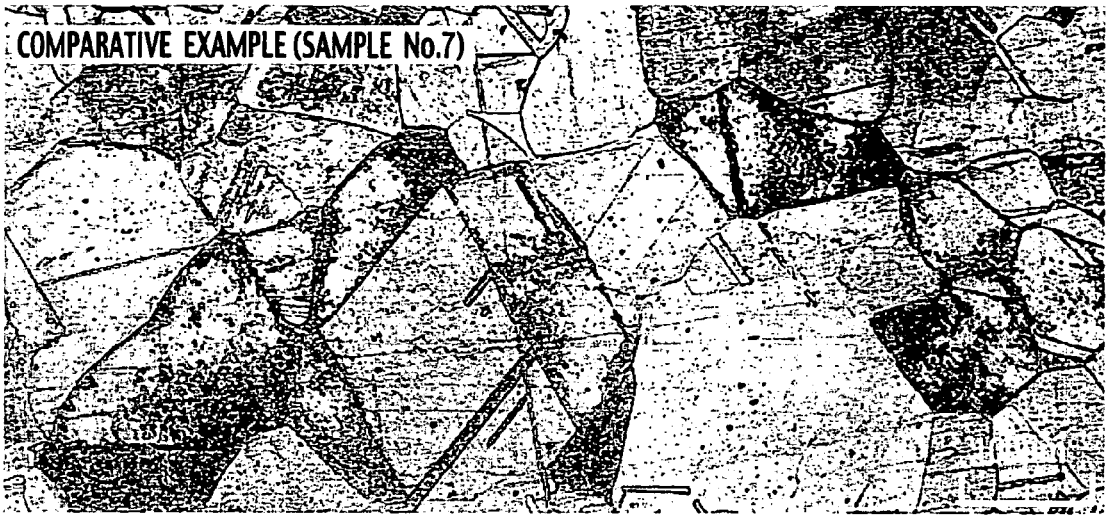
FIG. 3 shows crystal grains of a beryllium copper alloy of a comparative example.

A result of comparison between crystal grains of the beryllium copper alloy of the embodiment of the present invention and crystal grains of the beryllium copper alloy of the comparative example will be described below with reference to the accompanying drawings. FIG. 3 shows the crystal grains of the beryllium copper alloy of the above-described Sample No. 7, and FIG. 4 shows the crystal grains of the beryllium copper alloy of the above-described Sample No. 1.

Figure 4:
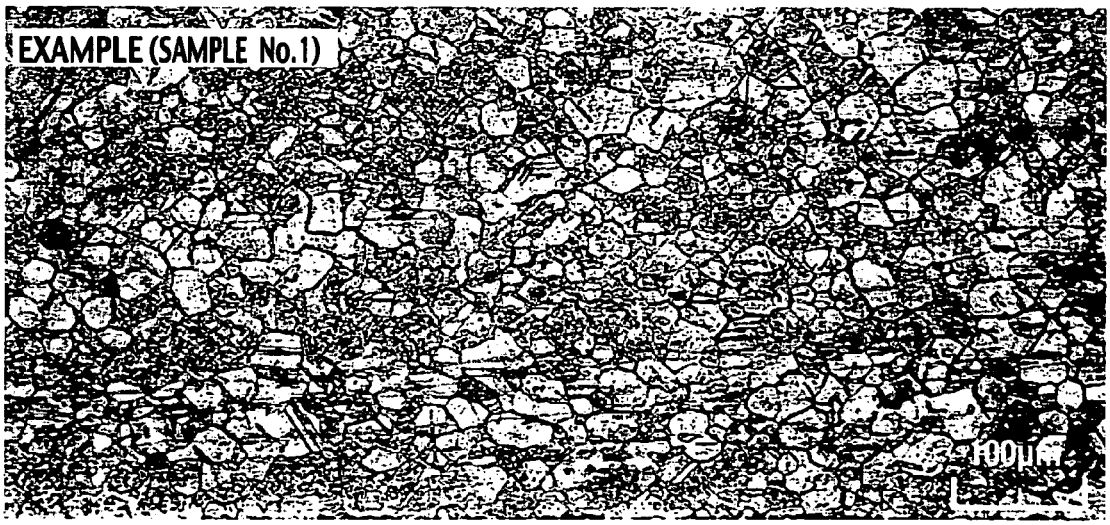
FIG. 4 shows crystal grains of the beryllium copper alloy of an example of the preset invention.

FIG. 3 and FIG. 4 show that the crystal grains of the beryllium copper alloy of the above-described Sample No. 1 has the average crystal grain size considerably smaller than that of the beryllium copper alloy of the above-described Sample No. 7.

What is claimed is:

1. A beryllium copper alloy, comprising:

a thickness "t" in a range from 0.05 mm to 0.5 mm;

an alloy composition consisting by weight (or mass %) of $Cu_{100-(a+b)}Ni_aBe_b$, wherein $1.0 \leqq a \leqq 2.0$, $0.15 \leqq b \leqq 0.35$, and $5.5 \leqq a/b \leqq 6.5$;

a 0.2% proof stress equal to or above 650 MPa;

an electric conductivity equal to or above 70% IACS; and a bending formability defined by a ratio of R/t=0, wherein "R" is a maximum bend radius before cracking at a bent portion when the beryllium copper alloy is bent into a V shape at a right angle.

2. The beryllium copper alloy according to claim 1, wherein crystal grains formed in the beryllium copper alloy have an average crystal grain size in a range of 5 μm to 35 μm.

3. The beryllium copper alloy according to claim 1, wherein a difference between an ultimate tensile strength of the beryllium copper alloy and the 0.2% proof stress of the beryllium copper alloy is equal to 40 MPa or more.

* * * * *

UNITED STATES PATENT AND TRADEMARK OFFICE

CERTIFICATE OF CORRECTION

PATENT NO. : 7,628,873 B2
APPLICATION NO. : 11/518507
DATED : December 8, 2009
INVENTOR(S) : Ota et al.

It is certified that error appears in the above-identified patent and that said Letters Patent is hereby corrected as shown below:

Column 1

*Line 60*: please change "LACS" to --IACS--

Signed and Sealed this

Twenty-seventh Day of April, 2010

David J. Kappos

David J. Kappos
*Director of the United States Patent and Trademark Office*